United States Patent [19]
Smith
[11] 4,318,261
[45] Mar. 9, 1982

[54] ROOF PANEL AND HOLD DOWN CLIP THEREFOR

[75] Inventor: Glenn W. Smith, Russells Point, Ohio
[73] Assignee: Larry Lieberman, Columbus, Ohio

[21] Appl. No.: 107,163
[22] Filed: Dec. 26, 1979
[51] Int. Cl.[3] ..... E04C 5/16
[52] U.S. Cl. ..... 52/582; 52/715; 52/741; 52/762
[58] Field of Search ..... 52/715, 712, 582, 741, 52/762, 763, 772, 483

[56] References Cited

U.S. PATENT DOCUMENTS

| | | | |
|---|---|---|---|
| 2,363,164 | 11/1944 | Waller | 52/772 X |
| 2,389,964 | 11/1945 | Eckel | 52/715 X |
| 2,394,443 | 2/1946 | Guignon, Jr. | 52/582 X |
| 2,407,004 | 9/1946 | Guignon, Jr. | 52/582 |
| 3,509,674 | 5/1970 | Birum, Jr. | 52/772 X |
| 3,881,292 | 5/1975 | Porter | 52/483 X |
| 3,892,099 | 7/1975 | Worgan et al. | 52/483 X |
| 3,910,001 | 10/1975 | Jackson | 52/712 X |
| 4,120,122 | 10/1978 | Bahr | 52/715 X |

*Primary Examiner*—Price C. Faw, Jr.
*Assistant Examiner*—Carl D. Friedman
*Attorney, Agent, or Firm*—Wood, Herron & Evans

[57] ABSTRACT

A clip comprises a lower leg at right angles to a shank and two upper legs defined by a slot extending upwardly from said shank. The shank is disposed in a slot in a connecting beam disposed between the ends of adjacent panels, and the lower leg of the clip is secured to a joist member before the adjacent panel is secured to the panel already in place. Upper and lower facing sheets on each panel extend beyond the insulating panel core and envelop respective edge portions of the connecting beam for attachment thereto.

18 Claims, 4 Drawing Figures

ROOF PANEL AND HOLD DOWN CLIP THEREFOR

This invention relates to methods and apparatus for panel constructions and more particularly to apparatus for securing insulated panels to roof joists and methods thereof.

Recently, it has become desirable to utilize roof panels in constructing a roof. Preferred are those insulated roof panels which include, for example, a foam insulating core and facing sheets on each side of the core. Typically, installation of such panels includes laying them on roof joists and then securing them to the joists by, for example, drilling a hole through the edge of a panel and the joist and inserting a threaded tie bolt therethrough. Nuts are then screwed onto the respective ends of the bolts to maintain the panels in place.

Such construction has numerous disadvantages. To begin with, two persons at a minimum are required to position the bolts and tighten the nuts; moreover, one of these persons must be located beneath the joist to aid orientation of the bolt and to tighten the bottom nut.

Secondly, such panels are frequently used in commercial installations where steel joists of I-beam configuration are used. It is very difficult for a person located above the thick roof panel to accurately drill through the panel's edge and into the upper joist flange in a proper position. The hole is easily misaligned either too close to the joist web or to the flange edge.

Also, in large installations, the cost of drills, time in assembly, bolts and nuts, and manpower is large.

Accordingly, it has been one objective of this invention to provide improved apparatus for securing panels to joists.

A further objective of the invention has been to provide improved methods for securing panels to joists.

A further objective of this invention has been to provide improved roof apparatus.

A still further objective of the invention has been to provide improved panel and panel hold-down apparatus.

To these ends, a preferred embodiment of the invention contemplates a clip having a lower leg for connection to a joist, a shank for extending upwardly from the leg and through a slot in a panel beam between two adjacent panels, and two upper legs on the shank which can be folded in opposite directions and over adjacent panels to hold them down. To accommodate the slot and shank, the upper sheets of the insulated panels each respectively cover only a portion of the beam.

In use, the shank is slipped into the slot from one edge of a first panel and the lower leg is secured to the joist at a point where it is easily reached. For this purpose the leg extends away from the panel having the beam in which the shank is disposed. An adjacent panel is then slid into place over the leg, the first panel being slightly lifted to accommodate the lower sheet of the second adjacent panel between the beam and the lower leg of the clip. The upper legs are then bent over the respective panels and secured, and the upper sheet of the adjacent panel is secured to a respective portion of the beam it covers.

The improved apparatus and methods have numerous advantages over the old. First, the clip of the invention is made very cheaply from thin metal stampings. Secondly, the clip is positioned and secured from above the joist and in a position where the lower leg is easily reached for accurate attachment to the joist. No operation from below the joist is required. Also, the upper legs are bent over by simply pushing them or by hitting them with a hammer. Moreover, long holes through the panels are not required.

When in place the panel ends are integrally connected to each other by way of the common connecting beam, producing a strong joint.

The upper legs of the clip are formed from the shank by an elongated slot which is long enough to permit the legs to accommodate panels of varying thicknesses without requiring different sized clips. As the panels get thicker, the bent over legs are simply shorter, but this does not materially reduce the hold-down capabilities of the clip.

While these are but some of the advantages of the invention, many others will become apparent from the following detailed description of a preferred embodiment of the invention and from the drawings in which.

Figure 1:
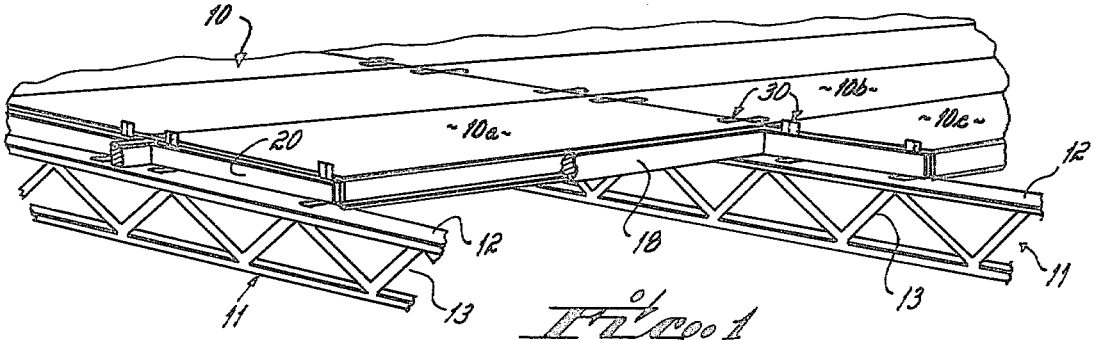
FIG. 1 is a perspective view showing a plurality of roof panels in place on roof joists.

Turning now to the drawings, and particularly to FIG. 1 thereof, there is illustrated a plurality of roof panels 10. Three of the panels in FIG. 1 are designated particularly at 10*a*, 10*b* and 10*c* in connection with which the installation of the panels will be more particularly described.

The panels are mounted on a series of fabricated steel joists 11. Such joists typically are of I-beam construction or of fabricated construction as shown, both having an upper flange 12 and a solid or strut-like web 13. Alternately, the joists could be wood, or could take other suitable form.

Figure 2:
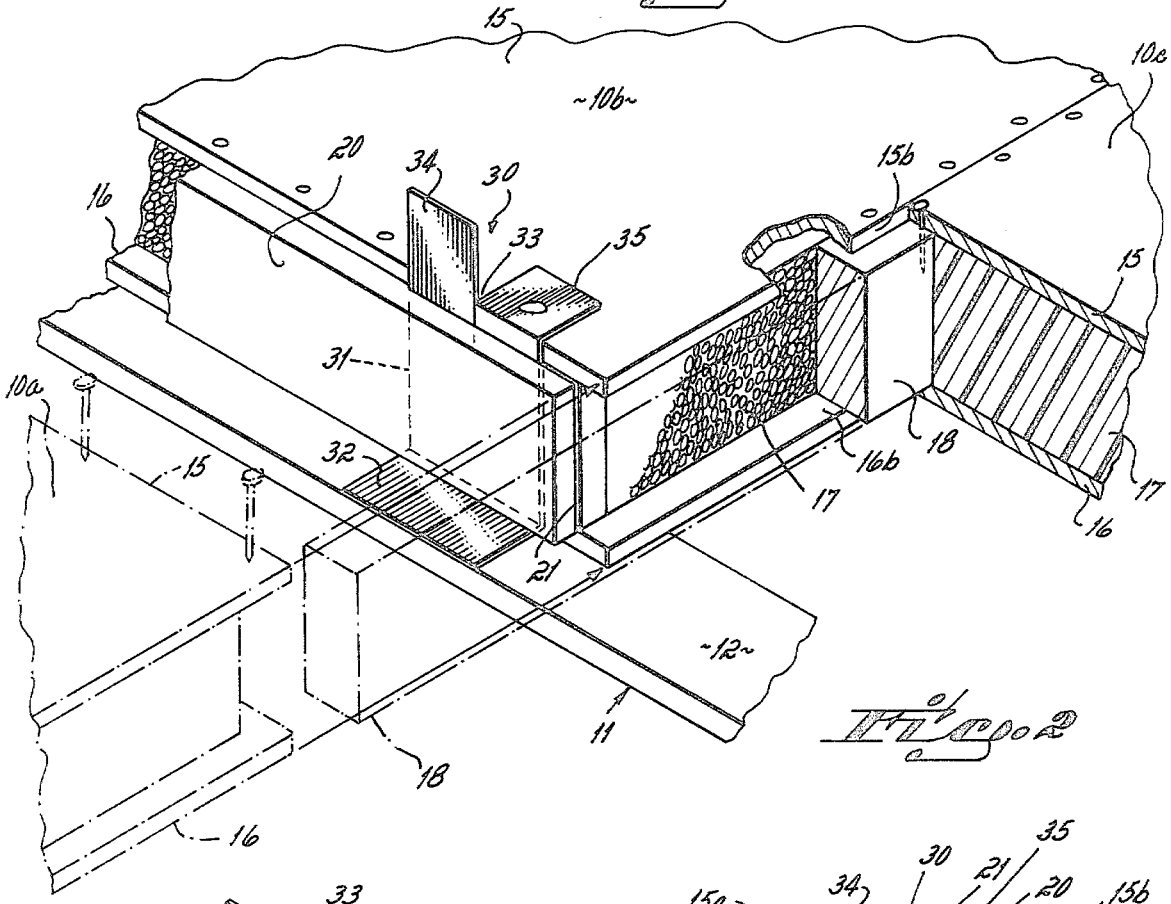
FIG. 2 is a perspective cut-away view showing details of the panel mounting.

The details of typical panel 10*b* are more particularly shown in FIG. 2. For clarity, like parts of each panel will be identified with like numbers followed by a suffix letter indicating the specific panel.

Each panel 10 is similar to panel 10*b* and includes an upper facing sheet 15 and at least one lower facing sheet 16. In a preferred embodiment, the sheets are adhesively laminated to an insulating foamed core 17. Each of the upper and lower sheets 15 and 16 may be, for example, one-half inch plywood, while the central foamed core 17 can be foamed polystyrene or any suitable insulating material. Alternately, of course, the lower side of the panel could also be provided with a fire code gypsum, for example, or some other material or surface, if desired. Such panels are basically well-known in the market place, with the exception, however, of the modifications as provided by this invention.

As particularly shown in FIG. 2, the panels according to the invention are constructed so that the upper and lower facing sheets 15 and 16 overlap the foamed core 17 a predetermined distance at both side and end edges of each panel. Thus the upper and lower sheets 15 and 16, respectively, overlap the upper and lower edges of an intermediate panel beam 18, for example, as shown in FIG. 2 sheets 15*b* and 16*b* on the side of the panel 10*b*. Additionally, the upper and lower sheets overlap approximately one-half the upper and lower edges, respectively, of a connecting beam 20.

Connecting beam 20 extends along the end of panel 10*b* and is co-terminous with the foamed core 17. This beam is preferably not an original part of the panel but is assembled thereto at the job site. Alternately, one such beam can be prefabbed into one end of each panel as an original part thereof.

The connecting beam 20 is provided at each end with a slot 21 which is disposed in the beam as shown perpendicularly or transversely to the sheets 15 and 16. The slot extends inboard of the beam at least several inches.

Figure 3:
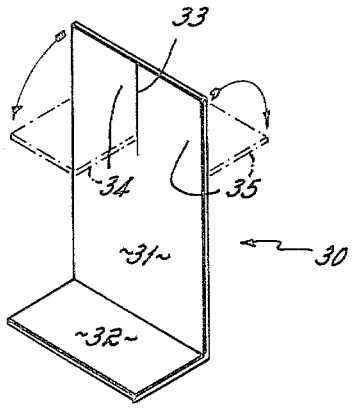
FIG. 3 is a perspective view of the clip of the invention.

The panels are mounted to the joists 11 by way of a roof or panel clip means 30 as shown in FIG. 3. The clip means 30 comprises a shank portion 31, a lower leg 32, which is disposed at right angles to the shank portion, and a slot 33 which extends downwardly from an upper edge of the shank toward the lower leg to define separate upper legs 34 and 35. The clip means 30 can be manufactured from relatively thin metal sheets, such as thin, sheet-rolled steel. By way of example, the thickness can be about 16 to 26 gauge.

When in place, the clip means 30 is disposed as shown in FIG. 2 wherein the shank 31 fits within the slot 21 of the connecting beam. In this position, the lower leg 32 extends in a direction away from the panel 10*b*, and outwardly from beneath the connecting beam 20 a sufficient distance so that the lower leg can be easily reached for welding it to the flange 12, for power-screwing it thereto, or for otherwise connecting it to the joist.

Of course, it will be appreciated that steel, wood or other forms of joists may be used, and the clip means 30 can be secured thereto in any suitable fashion. In this connection, it should also be appreciated that the length of the lower leg 32 is substantially greater than that portion of the connecting beam 20 under which it lies, so that the lower leg is readily accessible from above for connecting it to the joist 11.

Also in connection with FIG. 2 it should be noted that while one of the upper legs 35 of the clip means 30 is shown in bent-over position over the sheet 15, this is for illustration only and it should be noted that the leg 35 is not actually bent over the panel 10*b* until after an adjacent panel, such as panel 10*a*, shown in phantom in FIG. 2, is moved into position.

Figure 4:
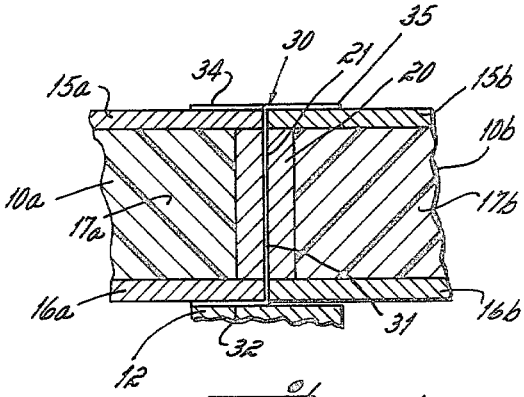
FIG. 4 is a cross-sectional view of two adjacent panels and clip in place.

Also referring to FIGS. 2 and 4, it will be noted that the leg 32 of the clip has a thickness which is less than the thickness of the lower sheet 16 of the panels 10. Accordingly, when the panel 10*b* is in place, the lower sheet 16*b* rests on the upper flange 12 of the joist 11 (FIG. 2). On the other hand, when panel 10*a* is urged into place after the lower leg 32 is connected to the joist 11, panel 10*b* is slightly spaced from the joist and the lower sheet 16*a* of panel 10*a* rests on the lower leg 32, slightly raised from the joist flange 12. This is depicted by the similar relationship of panels 10*a* and 10*b* in FIG. 4.

The assembly of a roof using panels 10 and clip means 30 will now be described. In FIG. 1, for example, it will be appreciated that panels 10*a*, 10*b* and 10*c*, as well as the other panels shown, are all in place. Now referring to FIG. 2, assembly will be described as if panels 10*b* and 10*c* are in place, and panel 10*a*, shown in phantom, is in position for assembly to the flange 12 of joist 11 in end-connecting relationship with panel 10*b*. In this connection, it will be appreciated that a clip 30 has already been positioned in slot 21, and secured to flange 12 (FIG. 2). Also it should be noted that panel 10*c* is broken away in FIG. 2 to more clearly illustrate the construction of the invention.

When panel 10*a* is to be moved toward panel 10*b*, panel 10*b* is slightly lifted to permit the leading edge of the lower sheet 16*a* to slide beneath the connecting beam 20, and over the upper surface of the lower legs 32 of the roof clips. Once the panel 10*a* has been moved into place, so its upper and lower sheets overlie the previously uncovered portions of the connecting beam 20, the upper legs 34 and 35 of the respective roof clips are bent over to the positions shown in phantom in FIG. 3, in order to hold down both panel 10*b* (leg 35) and panel 10*a* (leg 34). The upper sheet 15*a* is then nailed into the upper edge of the connecting beam 20, and the legs 34 and 35 can be nailed, screwed or otherwise connected to the respective panels in order to positively hold the panels. In this connection, the upper legs 34 and 35 could be predrilled, where the use of nails is contemplated.

The completed panel joint and joist tie-down, utilizing the panel clip 30, is depicted in FIG. 4. The rearward end of panel 10*a* is shown joined to the forward end of panel 10*b*. In this connection, it shall be appreciated that panel 10*b* was slightly lifted to raise the connecting beam 20 and permit the lower sheet 16*a* to slide beneath the connecting beam 20 and over the lower leg 32 of the panel clip. Accordingly, when the panels are in place, the panel 10*a* and specifically the lower sheet 16*a* thereof, rests on leg 32 and tends to support the connecting beam 20 and thus the adjacent panel, slightly above the flange 12.

The upper legs 34 and 35 of the clip 30 are not bent over until the ends of adjacent panels are in place. According to the invention, the legs can be simply hammered over and secured. If leg 35 was hammered over before panel 10*a* had been moved into place, it could be difficult to slide lower sheet 16*a* beneath beam 20. Then the legs 34 and 35 are not bent over until both panels are in proper end-to-end relation.

While FIG. 1 indicated that two roof clips 30 are used at each end of each panel, and thus that the connecting beam 20 extends only from near one edge of the panel to near the other, it should be appreciated that the intermediate beams 18 can extend any predetermined length, for example, from one edge of the panel core to the other, or beyond the panel core and into an area for connection to the next adjacent panel. In this connection, the panels are preferably furnished separately and the intermediate beams 18 fitted to the longitudinal side edges of the panels once the panels have been secured in place by means of a roof clip 30. As shown in FIG. 2 then, a connecting beam 18 extends forwardly of an end of the panel 10*b*, over the joist flange 12 and into a further area for connection to the panel 10*a*. Of course, the beam portion 18, shown in phantom, is preferably placed after the clip 30 is disposed within slot 21.

It shall be further appreciated that the roof panels and roof clips as herein described are particularly useful for many types of roofs, including use with finish roofing, shingle roofing or makeup or composition-type roofing. Moreover, in a preferred embodiment, the panels are approximately 4 and ½ inches in overall thickness, each of the facing sheets being approximately ½ inch thick and the foam core being approximately 3 and ½ inches thick. Accordingly, the intermediate beam 18 and the connecting beam 20 may in a panel of these dimensions comprise 2×4 lumber assembled on the job as the panels are joined.

It should be appreciated, however, that the panel thickness can vary substantially, for example, from 4 and ½ inches or below up to 6 and ½ inches and beyond. In this connection, it shall be noted that the slot 33 and the shank 31 of the roof clip is long enough to permit the legs 34 and 35 to be used in operative conjunction with panels of varying thicknesses. The portion of the shank between the lower leg 32 and the bottom of the slot 33 thus is slightly less than the thickness of the minimum thickness panel with which the clip is to be used. For example, if minimum panel thickness is to be 4 and ½ inches, the unslotted shank portion may be about 4 to 4 and ½ inches long. From that point, the remainder of the shank, as defined by the two legs 34 and 35, is long enough to accommodate panels of greater thicknesses. Thus one roof clip size is useful for panels of from 4 and ½ to 6 and ½ inches and beyond. In this connection, of course, it will be appreciated that as the panels get thicker, the legs 34 and 35, as they are bent over, become shorter. This does not materially effect the hold-down capabilities of the roof clip for the particular panels with which it is used. It should also be noted that the length of the upper legs when bent over is actually responsive to the thickness of the panel with which the clip 30 is used.

These and other advantages and modifications will become readily apparent to those of ordinary skill in the art, without departing from the scope of this invention, and the applicant intends to be bound only by the claims appended hereto.

I claim:

1. Mounting apparatus for mounting roof panels, having a core and upper and lower facing sheets on said core, to roof joists, said mounting apparatus comprising:

a beam for connecting the ends of one panel and an adjacent panel, an upper one of said sheets on each panel overlying a portion of said beam when it is disposed between two panels, at least one slot in said beam disposed substantially perpendicularly to said sheets, a clip means having a shank for extending through said slot, said clip means having a lower leg on said shank parallel to said sheets when in said slot for attachment to a roof joist, and at least one upper leg, on said shank, for folding over said one of said sheets.

2. Apparatus as in claim 1 further including an additional upper leg for folding over an upper sheet of an adjacent panel.

3. Apparatus as in claim 2 wherein said upper legs, when folded, are parallel but extend at opposite directions to each other.

4. Apparatus of claims 1, 2 or 3 wherein said lower leg is disposed at a right angle with respect to said shank in a direction away from a lower facing sheet of said one panel.

5. Apparatus as in claim 4 wherein said lower leg supports a lower sheet of an adjacent panel.

6. Apparatus of claim 5 wherein said one panel is spaced from a joist when an adjacent panel and said one panel are mounted to said joist by said clip means.

7. Apparatus of claim 3 wherein said shank includes a slot defining and separating said upper legs.

8. Apparatus of claim 7 wherein said shank, between said lower leg and a lower end of said slot therein, extends a distance less than the thickness of a panel.

9. Apparatus of claim 1 wherein each of said one panel and an adjacent panel include upper sheets overlying respective portions of said beam, said shank of said clip means extending between said upper sheets when in said slot between panels to be joined.

10. Apparatus of claim 9 wherein said clip means includes two upper legs on said shank, one leg folded over one of said upper sheets and another leg folded over another of said upper sheets when adjacent panels are joined.

11. Apparatus of claim 1 wherein said slot in said beam is longer than the width of said shank.

12. A method of securing roof panels to roof joists, the panels being of the type having a core and facing sheets laminated thereto, the facing sheets extending beyond said core, and at one end of each panel over portions of a connecting beam, and including the steps of:

inserting a clip means in a slot in at least one end of said connecting beam in one panel, said clip means having a shank, two upper legs and a lower leg at right angles to said shank, said lower leg extending in a direction away from said one panel, securing said lower leg to a roof joist, sliding an adjacent panel, having facing sheets overlapping the core thereof, against said one panel, said sheets overlapping other portions of said connecting beam, and securing said upper legs to said respective panels.

13. A method as in claim 12 wherein said step of securing said upper legs includes the steps of:

bending one of said upper legs of said clip means over said one panel, and bending another one of said upper legs of said clip means over said adjacent panel.

14. A method as in claim 12 including the step of securing an upper overlapping facing sheet to overlapped portions of said connecting beam.

15. A method as in claim 12 including the step of lifting said one panel and sliding a lower overlapping lower sheet of said adjacent panel between said lower leg of said clip means and said connecting beam.

16. Roof apparatus comprising:

a plurality of insulated panels each having an insulating core and upper and lower facing sheets laminated thereto, said sheets overlapping said core at edges thereof, an intermediate beam means for connecting side edges of adjacent panels together, at least upper sheets of adjacent panels connected to said intermediate beam means along said adjacent panel side edges, a connecting beam means for connecting end edges of adjacent panels together, at least upper sheets of adjacent panels connected to said connecting beam means along said adjacent panel end edges, a slot at each end of said connecting beams, said slots disposed transversely to said upper sheets and being elongated in a direction from one end of the respective connecting beam toward another end thereof, and clip means disposed in said slots, said clip means having a lower leg adapted for connection to a roof joist, a shank extending through said slot, and two upper legs for holding said end edges of adjacent panels.

17. Apparatus as in claim 16 wherein said lower leg is disposed at right angles to said shank and wherein said upper legs are defined by a slot extending upwardly from said shank.

18. Apparatus as in claim 17 wherein said shank is of a length no greater than the thickness of said panels and said upper legs are folded over adjacent respective panels.

* * * * *